United States Patent [19]

Sutton

[11] 3,984,876

[45] Oct. 12, 1976

[54] ARTICLE OF CLOTHING

[76] Inventor: Evelyn L. Sutton, 13521 Grandmont, Detroit, Mich. 48227

[22] Filed: Jan. 16, 1975

[21] Appl. No.: 541,519

[52] U.S. Cl. ..... 2/48; 2/49 R

[51] Int. Cl.[2] ..... A41B 13/10

[58] Field of Search ..... 2/49 R, 48, 119, 118, 2/103, 92

[56] References Cited

UNITED STATES PATENTS

| | | | |
|---|---|---|---|
| 148,177 | 3/1874 | Chase | 2/119 X |
| 258,446 | 5/1882 | Link | 2/119 X |
| 1,564,897 | 12/1925 | Sanborn | 2/48 |
| 2,425,635 | 8/1947 | Notzberg | 2/49 R |
| 2,556,039 | 6/1951 | Landert | 2/119 X |
| 2,688,136 | 9/1954 | Freedman | 2/103 X |
| 2,922,164 | 1/1960 | Liff | 2/49 R |
| 3,099,013 | 7/1963 | Thorpe | 2/92 X |
| 3,146,464 | 9/1964 | Burnett | 2/49 R |

FOREIGN PATENTS OR APPLICATIONS

| | | | |
|---|---|---|---|
| 152,237 | 10/1920 | United Kingdom | 2/119 |

*Primary Examiner*—Alfred R. Guest

*Attorney, Agent, or Firm*—Irving M. Weiner; Pamela S. Burt

[57] ABSTRACT

An article of clothing comprising a main body, a removable protective member and means to fasten the member to the front of the main body. The member protects the wearer by acting as a bib which may either be cleaned and replaced or may be disposed of. The bib may also contain pockets to hold articles which are thereby easily accessible.

7 Claims, 6 Drawing Figures

ARTICLE OF CLOTHING

The present invention relates to an article of clothing, and in particular to a blouse cover with a removable and replacable protective front member.

BACKGROUND OF THE INVENTION

It is well known in the art to provide for "false fronts" on articles of clothing. These false fronts are typically removable and replaceable to provide variety to the user.

U.S. Pat. No. 148,177 discloses an interchangeable shirt-bosom. A mat stitched to the shirt prevents other garments from catching against the edge of the bosom.

U.S. Pat. No. 2,556,039 relates to a woman's blouse with a reversible front panel that buttons behind the neck and down the front. It is a non-disposable, decorative garment, the front panel having a different design on either side.

U.S. Pat. No. 2,688,136 relates to decoratively fringed pieces of cloth which may be buttoned around the collar, down the front of a garment, or along any other section of a garment as desired.

U.S. Pat. No. 2,922,164 relates to a shirt designed for infants that has a permanently attached plastic front and a removable cloth bib that snaps over the plastic to give a sportier appearance.

U.S. Pat. No. 3,099,013 relates to an article of clothing that fits around the neck and can be folded or buttoned in four different styles.

The instant invention provides protection by a detachable and replaceable bib which is fastened to a blouse cover. The blouse cover is thereafter worn over other clothing. The prior art inventions either do not provide for such protection, as their detachable parts are merely decorative in function, or such protection is provided by some other part of the clothing.

SUMMARY OF THE INVENTION

The present invention provides an article of clothing which is adapted to be worn over a blouse or shirt. A main body member defines a shoulder portion and a neck opening. Fastening means are provided to removably attach an interchangeable protective member to the front of the main body member.

A further object of the invention is to provide a longitudinal slot which extends from the neck opening in the main body member to the bottom edge of the main body member. Said slot may thereafter be substantially covered by said protective member.

Another object of the invention is to provide pockets in said protective member which may also be decorative in style.

The protective member can be fastened to the main body member by means of a woven nylon fabric, in combination with a cloth fabric.

DETAILED DESCRIPTION OF THE PREFERRED EMBODIMENT

Figure 1:
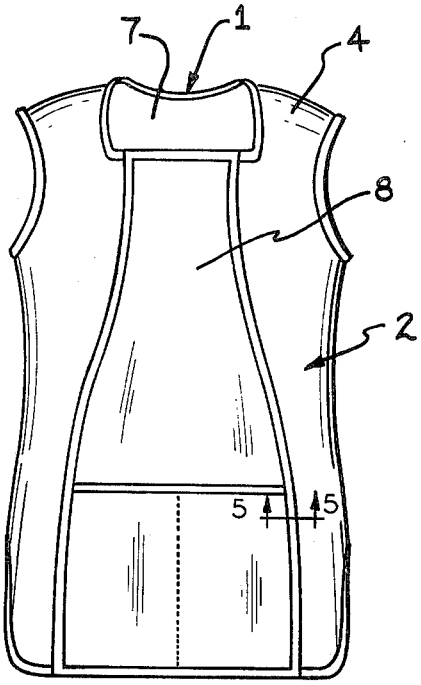
FIG. 1 illustrates a front view of the blouse cover shown with the front protective member attached.

Reference numeral 1 generally designates the main body member of the blouse cover herein described.

Figure 2:
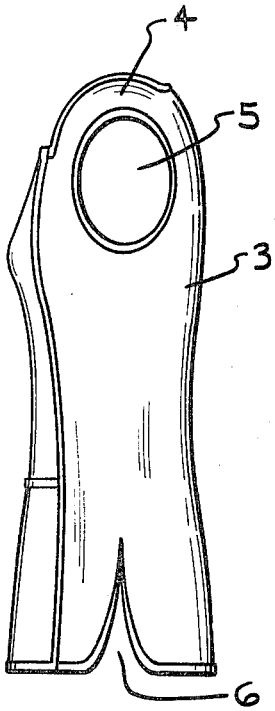
FIG. 2 depicts a side view of said blouse cover.

As seen in FIGS. 1 and 2, the main body member is comprised of two sections, a front section generally designated by reference numeral 2 and back section 3. The front and back sections are stitched together at the shoulder portion 4 and from arm holes 5 to slits 6 (such stitching not shown).

The front and back sections 2, 3 further define a neck opening 7. When interchangeable protective member 8 is affixed to the main body member 1, the neck opening 7 is completely encircled.

Figure 3:
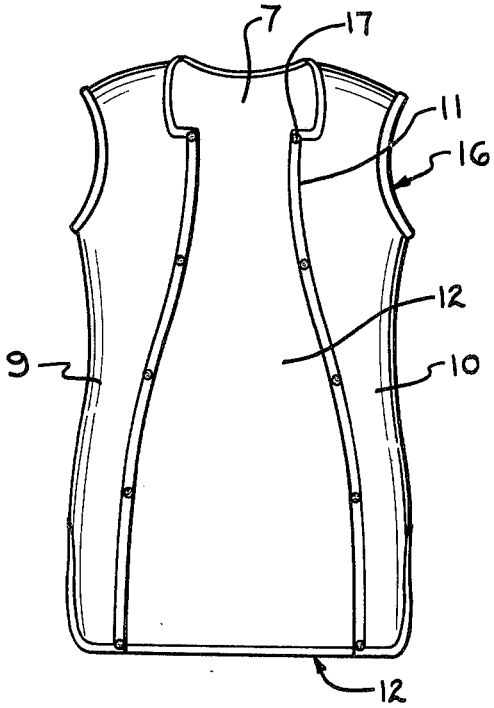
FIG. 3 is a front view of the blouse cover shown without the protected member, showing part of the fastening device attached along the inner front borders of the body member.

With reference now to FIG. 3, the front section 2 further comprises a left portion 9 and a right portion 10. As can be seen in FIG. 3, the left and right portions are edged with folded bias tape 11, along their inner edges from the neck opening 7 to the bottom edge 12 of the body member 1.

Both the main body member 1 and the protective member 8 are made of light cotton fabric in this preferred embodiment. Of course, the type of fabric is not essential to the practice of this invention. Also, the protective member 8 may be made as protective as the need requires, i.e., waterproof, tearproof, etc.

Returning again to FIG. 3, it can be seen that the two portions 9, 10 define a longitudinal slot 12, which is narrower near the top of the main body member 1 than at the bottom edge 12 of said member.

The presence of slot 12 allows the easy removal and replacement of said body member when the protective member 8 is not affixed to said body member. The presence of said slot also means that less material need be employed in constructing the body member 1.

Figure 4:
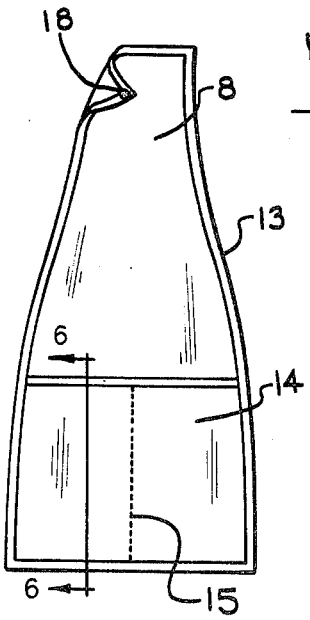
FIG. 4 shows the protective member apart from the main body member. The upper part of the protective member has been turned to show the complementary part of the fastening device. Pockets on the protective member are also shown.
Figure 6:
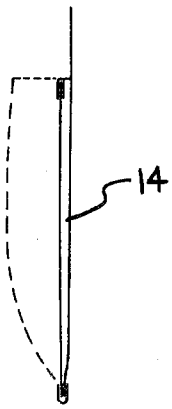
FIG. 6 is a sectional detail view taken along the plane of line 6—6 in FIG. 4, the phantom line showing the pocket in its expanded position.

FIG. 4 shows folded bias tape 13 which trims the outer edges of protective member 8 and the top edge of pockets 14. Pockets 14 are further shown in FIG. 6, the phantom line showing the pocket in its expanded position.

Said pockets are separated by stitches 15 in FIG. 4.

Folded bias strips generally indicated as 16 further line the borders of the main body member 1, at the arm holes 5, the bottom edge 12, the slits 6 and the neck opening 7.

Fastening means which removably affix the protective member 8 to the front section 2 of the main body member 1 may comprise a woven "nylon-type" fabirc which is commercially known as VELCRO. Such a woven fabric can be removably affixed to many types of cloth and other surfaces to which it is brought into contact. Removal or separation of such type of woven fabric can be readily achieved through manual separation.

Figure 5:
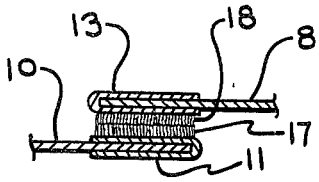
FIG. 5 is a sectional view taken along the plane of line 5—5 in FIG. 1, showning the fastening means with more particularity.

In the instant invention VELCRO buttons 17 are sewed to bias tape 11 and complementary fabric buttons 18 are sewed to the underside of bias tape 13. The VELCRO buttons 13 and the fabric buttons 18 are provided in a one-to-one correspondence with each other, and each such complementary pair of buttons is substantially aligned with another as shown in FIG. 5. All such pairs of buttons are substantially aligned with one another in FIG. 1, wherein the protective member 8 is affixed to the front section 2 to substantially cover the longitudinal slot 12.

In practicing the present invention the blouse cover herein described may be sleeveless as depicted in FIG. 1. However, the practice of the invention is not limited to articles of clothing without sleeves.

It is further provided that the protective member 8 may have a decorative motif in full compliance with the instant invention.

I claim:

1. An article of clothing comprising in combination:

a main body member having a back section and two front sections of substantially equal dimensions defining a shoulder portion and a neck opening;

said two front sections define a longitudinal void which extends from said neck opening to the bottom edge of said main body member;

a removable and interchangeable protective member; and fastening means which removably affixes said interchangeable protective member to said two front sections of said main body member so as to substantially cover said longitudinal void.

2. The invention according to claim 1, wherein said interchangeable protective member includes at least one pocket.

3. The invention according to claim 1, wherein said main body member comprises a sleeveless shirt body.

4. The invention according to claim 1, wherein said fastening means includes a woven nylon fabric.

5. The invention according to calim 3, wherein said interchangeable protective member extends from said neck opening to the bottom edge of said shirt body.

6. The invention according to claim 5, wherein said interchangeable protective member is substantially wider at the bottom edge of said shirt body than at said neck opening.

7. The invention according to claim 1, wherein said interchangeable protective member has a decorative motif.

* * * * *